United States Patent [19]

Clark et al.

[11] Patent Number: 4,838,732

[45] **Date of Patent: * Jun. 13, 1989**

[54] ELASTOMERIC SEALING DEVICE

[76] Inventors: Stephen E. Clark, 1344 Monterey Ave.; Earl A. Clark, 1143 Manchester Ave., both of Norfolk, Va. 23508

[ * ] Notice: The portion of the term of this patent subsequent to Apr. 18, 2002 has been disclaimed.

[21] Appl. No.: 377,669

[22] Filed: May 12, 1982

[51] Int. Cl.[4] ..... E02B 3/16; E02D 29/14; A47K 1/14

[52] U.S. Cl. ..... 405/52; 405/270; 405/303; 52/20; 404/2; 404/25; 210/163; 4/293

[58] Field of Search ..... 405/18, 19, 38, 52, 405/53, 57, 270, 303; 52/20; 404/2, 4, 25, 26; 210/163, 164; 4/286, 293–295

[56] References Cited

U.S. PATENT DOCUMENTS

| | | | |
|---|---|---|---|
| 1,739,067 | 12/1929 | Fleming . | |
| 1,912,312 | 5/1933 | Schacht . | |
| 1,981,358 | 11/1934 | Hernandez . | |
| 2,003,770 | 6/1935 | Goodhart . | |
| 2,472,322 | 6/1949 | Weissman | 210/163 |
| 2,611,904 | 9/1952 | Gross . | |
| 2,771,745 | 11/1956 | Bramble | 405/270 |
| 3,032,062 | 5/1962 | Blahnik | 210/163 X |
| 3,263,580 | 8/1966 | MacMillan | 404/25 |
| 3,445,973 | 5/1969 | Stone | 210/163 X |
| 3,474,625 | 10/1969 | Draper | 405/270 |
| 3,901,405 | 8/1975 | Norberg . | |
| 4,035,543 | 7/1977 | Draper et al. | 405/270 X |
| 4,101,236 | 7/1978 | Meyer . | |
| 4,154,061 | 5/1979 | Umemoto et al. | 405/19 |
| 4,203,686 | 5/1980 | Bowman | 404/25 |
| 4,305,679 | 12/1981 | Modi . | |
| 4,371,288 | 2/1983 | Borca | 405/53 |

*Primary Examiner*—Randolph A. Reese
*Assistant Examiner*—John A. Ricci

[57] ABSTRACT

An elastomeric sealing device to prevent ingress of surface fluids into holes, principally drains which are characterized by non-watertight covers or grilles with either regular or irregular topographic boundaries. The device comprises a three-part construction, including a top film, a core elastomer having minimal shear strength, and a bottom film. When in use, the device conforms to contour of adjacent hole covering device and fills existing crevices and voids, thereby providing an efficient seal. When removed from hole, device recovers neutral shape thereby being suitable for re-use on same or different hole.

3 Claims, 1 Drawing Sheet

ELASTOMERIC SEALING DEVICE

FIELD OF INVENTION

The present invention relates to an elastomeric sealer for holes with either regular or irregular topographic boundaries. More particularly, the present invention relates to an elastomeric sealer for storm drains, manholes, and other large holes characterized by having loose fitting covers, grates or grilles, which are susceptible to flooding.

DISCUSSION OF PRIOR ART

It is often desirable to temporarily close off drains from flooding by various liquids. In particular, when handling hazardous liquids in the vicinity of storm drains and manholes, it is often desirable to isolate said drains and holes from possible ingress of accidental hazardous liquids spills. Prior means to effect such isolation is provided by either custom fitted rigid covers, manual or automatic cutoff valves, or by covering with a flexible material, such as canvas, and covering said material with dirt or sand. The prior means of sealing off drains employing cutoff valves or custom-fitted rigid covers offer significent practical limitations to their usefulness. Both means require extensive preparation and installation efforts. Neither means can be easily adapted for use with an orifice or orifice covering device other than that with which it is specifically manufactured to mate. Once in place, neither prior means is readily suitable for removal, transport or re-installation at an alternative location. The complexity, and the corresponding high cost, of each of these means has rendered them generally impractical and rarely used for sealing drains and manholes from accidental flooding.

The prior means which employs a flexible material held in place upon a drainage grate by sand or dirt to effect a seal presents a problem inasmuch as said means is cumbersome and difficult to work with in emergency situations. The effected seal is of limited reliability due to the possibility of said covering sand or dirt being washed away or eroded when flooded. Said means offers only limited portability and reusability qualities. Further, said means provides little resistance to shear forces imposed by onrushing fluids, thereby reducing the integrity of the seal.

Existing mono-component semi-flexible stoppers such as are commonly used on sink drains are generally ineffective and unsuited for use on larger, outdoor drains. Such stoppers generally require a planar rim around the drain perimeter with which the stopper must mate, in order to provide a watertight seal. With such stoppers, seal integrity is not maintained when used in conjunction with grates or drains with irregular, nonpolar topography.

OBJECTS

Accordingly, the primary object of the present invention is to provide a simple, portable and reuseable means by which large holes, particularly drains and manholes, be sealed from incoming liquids.

A further object of the invention is to provide a sealing means of the character described which is constructed such that sealing be accomplished against grates, grilles, covers and casings with irregular topographic boundaries. Construction of the present invention is such that the limpness of the device allows it to sag into cracks, crevices, slots, perforations, and to generally conform to all ridges, curbs and hubs, thereby providing a watertight seal, regardless of topography, size, or shape of the opening or opening cover.

It is a further object of this invention to provide a sealing means whereby a single such device can perform with equal effectiveness when employed on a number of drains having different shapes, sizes and orientations, with equal effectiveness.

A further object of this invention is to provide a sealing means being constructed such that the limpness of the device provides resistance to lateral movement so as to uncover the drain and permit seepage of liquid past said device, such resistance to movement afforded by said device sagging into voids and around hubs which may exist within said drain's cover, grille or grate.

Further objects and advantages of the present invention will become apparent from consideration of the drawings and ensuring description thereof,

DRAWINGS

DESCRIPTION

Figure 1:
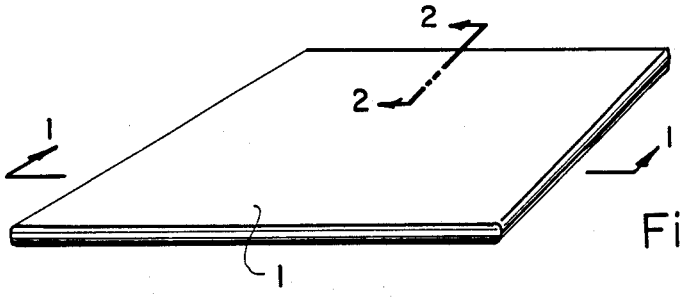
FIG. 1 is a perspective view of the top of the present invention.

As shown in FIG. 1, the invention preferably comprises a flexible elastomeric mat device (1) whose length and width are large relative to its thickness, and whose specific gravity is greater than one, and which is impermeable to liquids.

Figure 2:
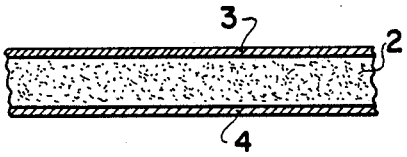
FIG. 2 is a partial vertical section taken on the line 1—1 of FIG. 1 of the invention.

The preferred embodiment of the invention comprises a three part construction as shown in FIG. 2. The core material (2) is a highly flexible elastomer exhibiting particularly low shear resistance characteristics. An upper film (3) and a lower film (4) are adjacent to the core material (2), providing the device with definition of shape. The upper film (3) and the lowr film (4) may be of similar or dissimilar materials.

The lower film (4) is a flexible material, offering only limited restriction to shear movement and flexible nature of the core material (2). Both the top film (3) and the bottom film (4) are thin relative to the thickness of the core material (2). Either the core material (2), the top film (3) or the bottom film (4), or any combination of components thereof, is impermeable to liquids.

The perimeter of the mat is constructed as shown in FIG. 3, FIG. 4, FIG. 5, or FIG. 6.

Figure 3:
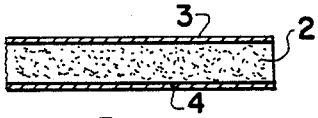
FIG. 3 is a partial section taken along line 2—2 of FIG. 1, showing a form of edge construction.

The edge construction shown in FIG. 3 has an exposed core (2). Any combination of the edge constructions shown in FIG. 3 through FIG. 6 may be used on a single mat.

Figure 4:
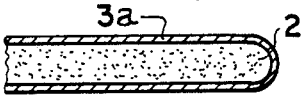
FIG. 4 is a partial section similar to FIG. 3, but with a modified edge construction.

The edge construction of the mat as shown in FIG. 4 comprises a single continuous cover material for the top and bottom film (3*a*).

Figure 5:
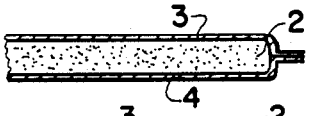
FIG. 5 is a partial section similar to FIG. 3, but with a modified edge construction.

The edge construction shown in FIG. 5 comprises top film (3) and bottom film (4) joined such that the core material (2) is not exposed.

Figure 6:
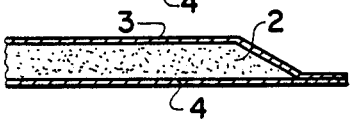
FIG. 6 is a partial section similar to FIG. 3, but with a still further modified edge construction.

In the preferred embodiment of the invention, the edge construction is as shown in FIG. 6. In FIG. 6, a modified edge construction is shown in which the upper film (3) is joined to the bottom film (4) so as to form a tapered edge with the top of the mat sloping down to the bottom of the mat.

OPERATION

Figure 7:
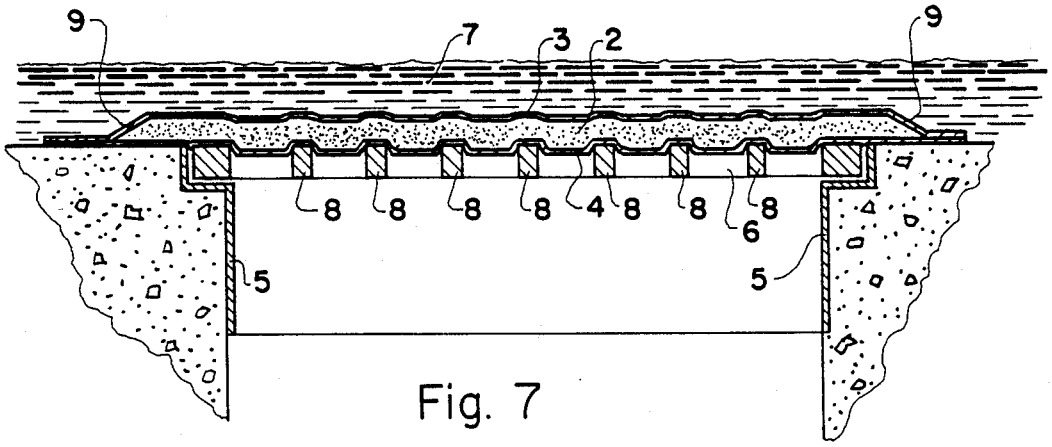
FIG. 7 is a vertical medial section through a storm drain with the present invention in place.

FIG. 7 shows the invention in place upon a typical storm drain. The drain shown in FIG. 7 has a frame (5) and a grate (6).

The specific gravity of the mat is greater than one, thereby causing surface fluid (7) having a specific gravity of one or less to float thereon. The composition of the invention is such that it is impermeable to liquids, thereby not allowing surface fluid (7) to pass vertically through to the storm drain. In the preferred embodiment of the invention the core material (2), the top film (3) and the bottom film (4) are all impermeable to liquids.

The core material (2) of the invention is an elastomer characterized by its particularly low resistance to shearing. The top film (3) and bottom film (4) provide definition to the shape of the mat without significantly restricting the shearing motion of the core material (2). When in place upon an irregularly shaped structure such as frame (5) and grate (6) in FIG. 7, the mat sags into open crevices and voids such as spaces between the individual rungs (8) of grate (6), and generally conforms to the contour of surfaces adjacent to and in contact with said mat. The weight of the mat is sufficient by itself to effect its conforming to irregular surfaces and sagging into crevices and voids. Further conforming to surfaces and sagging into adjacent crevices and voids is effected by the weight of any surface fluid (7) which is directly above mat. Such conforming to surfaces and sagging into crevices and voids effects a water-tight seal between the lower film (4) and the storm drain over the entire area of the mat.

Further, resistance to motion in the horizontal direction by the mat is effected by its sagging into the open spaces between grate rungs (8). In the preferred embodiment of the invention, further resistance to horizontal motion is afforded by the tapered edge (9) of the mat, (FIG. 6), which reduces horizontal flow forces against said edge of mat.

When removed from contact with other objects, the invention fully recovers its original shape, thereby being suitable for subsequent use on the same drain or any other irregularly contoured surface. Further, the mat may be folded or rolled without its losing memory of its original shape, thereby providing for manageability in storage and transport.

While the above description contains specificities, these should not be construed as limitations on the scope of the invention, but rather as an exemplification of one preferred embodiment thereof. Many variations are possible, for example variations in shape, different edge constructions, eliminations of the top film, or use of various film materials. Accordingly, the scope of the invention should be determined not by the embodiment illustrated, but by the appended claims and their legal equivalents.

I claim:

1. A device for sealing off holes that have irregular or non-planar boundaries from ingress of surface fluids into said holes comprising a core elastomer having a top surface and a bottom surface; said core elastomer having a thickness as measured between said top surface and said bottom surface that is small relative to the legnth of the perimeter of said top surface; said core elastomer having extremely low shear resistance whereby said core elastomer conforms, under its own weight, to the shape of said boundaries of said holes when said device is placed against said boundaries;

a top film adjacent to said top surface of said core elastomer being flexible, impermeable to liquids, and thin relative to said core elastomer; and a bottom film adjacent to said bottom surface of said core elastomer being flexible, impermeable to liquids, and thin relative to said core elastomer.

2. The device as described in claim 1 in which said top film and said bottom film are a continuous member.

3. A device for sealing off large holes, such as storm drains, that have irregular or non-planar boundaries from ingress of surface fluids into said holes comprising a nominally flat core elastomer having a top surface and a bottom surface;

said core elastomer being of specific gravity greater than 1, and having a thickness as measured between said top surface and said bottom surface that is small relative to the length of the perimeter of said bottom surface;

said core elastomer being of extremely low shear strength such that said core elastomer conforms, under its own weight, to the shape of said boundaries of said holes when said device is placed vertically above and in direct contact with said boundaries;

a top film adjacent to and covering said top surface of said core elastomer;

said top film being flexible, impermeable to liquids, and thin relative to said core elastomer; and a bottom film adjacent to and covering said bottom surface of said core elastomer;

said bottom film being flexible, impermeable to liquids, and thin relative to said core elastomer; and said top film being joined to said bottom film at said perimeter of said bottom surface of said core elastomer.

* * * * *